United States Patent [19]

Wilson

[11] Patent Number: 4,498,595

[45] Date of Patent: Feb. 12, 1985

[54] ICE BLOCK MAKING AND STORAGE SYSTEM

[76] Inventor: Roland B. Wilson, 1207 S. Lafayette St., Fort Wayne, Ind. 46802

[21] Appl. No.: 424,901

[22] Filed: Sep. 28, 1982

[51] Int. Cl.[3] ..... A47B 47/00

[52] U.S. Cl. ..... 211/194; 211/126; 211/188; 211/181; 211/71; 211/49 S; 206/513; 206/821

[58] Field of Search ..... 211/194, 126, 188, 181, 211/133, 71, 49 S; 206/821, 513, 501, 508, 505; 62/66, 340; 249/120, 126; 220/19

[56] References Cited

U.S. PATENT DOCUMENTS

| | | | |
|---|---|---|---|
| Re. 24,984 | 5/1961 | Wilson | 211/126 |
| 2,627,981 | 2/1953 | Bitney | 211/181 X |
| 2,889,054 | 6/1959 | Wheeler | 211/181 X |
| 3,037,659 | 6/1962 | Fredrick | 206/513 X |
| 3,333,722 | 8/1967 | Panknin | 206/821 X |
| 3,498,494 | 3/1970 | Voorhees, Jr. | 206/501 |
| 3,970,199 | 7/1976 | Marschak . | |
| 4,106,625 | 8/1978 | Carroll et al. | 206/501 X |

FOREIGN PATENT DOCUMENTS

| | | | |
|---|---|---|---|
| 2384679 | 11/1978 | France | 206/513 |

*Primary Examiner*—Ramon S. Britts
*Assistant Examiner*—Blair Johnson
*Attorney, Agent, or Firm*—Albert L. Jeffers; John F. Hoffman

[57] ABSTRACT

A method and apparatus for the home freezing of water in relatively large blocks for subsequent use in insulated portable ice chests for maintaining the contents cool over a period of days is disclosed and includes a plurality of support racks of truncated pyramidal configuration having open rectangular tops and bottoms and trapezoidal side walls of an open mesh configuration along with a like plurality of relatively flat floor panels each having a groove for receiving an upper edge of a subadjacent rack and a groove for receiving an edge of a superior rack so that a plurality of flexible open-topped containers may be stacked in a column in a freezer on successive floor panels with each floor panel supported by a corresponding rack to allow free air circulation around the containers to facilitate cooling as well as supporting and storing the water and the subsequent blocks of ice.

3 Claims, 5 Drawing Figures

ICE BLOCK MAKING AND STORAGE SYSTEM

BACKGROUND OF THE INVENTION

The present invention relates generally to the creation of relatively large blocks of ice as might be used in insulated portable ice chests on camping or fishing trips, as well as for other recreational purposes where it is desired to maintain foods or beverages at reduced temperatures over a period of as long as several days. More particularly, the present invention relates to an arrangement of support racks, floor panels and containers which may be stacked in a freezer to form relatively large blocks of ice for such uses.

The prior art technique for cooling ice chests and similar insulated containers includes the purchase of relatively expensive, commercially made and stored blocks of ice for use in such ice chests as well as the temporary expedient of using numerous trays of conventional ice cubes from the home refrigerator. Such techniques are relatively expensive and inconvenient. Closed containers of special materials having a high latent heat of fusion and suited for periodic refreezing in the home freezer or refrigerator have also been used, however, these materials are typically relatively expensive and container failure, for example due to rusting of the container, have rendered this approach unpopular.

It would be highly desirable to be able to pack a portable ice chest for use over a period of days without the time-consuming task of seeking out a source of commercial blocks of ice thereby also avoiding the expense of such commercial ice and without the typically inadequate use of all the conventional ice cubes in a home.

SUMMARY OF THE INVENTION

Among the several objects of the present invention may be noted the elimination of the above mentioned defects; the achieving of the above-noted desires; the provision of a method of home freezing water in relatively large blocks for subsequent use in insulated portable ice chests to maintain the contents thereof cool over a period of days; the provision of an arrangement for stacking a plurality of open-topped containers of water in a freezer while allowing free air circulation about the containers thereby avoiding container breakage due to expansion of the water when it freezes and consuming minimal freezer space; the provision of a container-stacking arrangement employing nestable support racks; and the adaptation of a home freezer as a ready supply of block ice. These as well as other objects and advantageous features of the present invention will be in part apparent and in part pointed out hereinafter.

In general, the stacking arrangement includes a plurality of support racks each of a generally truncated pyramidal configuration having open, generally parallel top and bottom rectangular faces and trapezoidal side walls formed as a grid of generally orthogonal wires along with a like plurality of relatively flat, generally rectangular floor panels, each having one face grooved to receive upper edges of side walls of a subadjacent rack and the opposite face grooved for receiving lower edges of a superior rack so that each floor panel may receive a water container to thereby form a column of such containers.

Also in general and in one form of the invention, the home freezing of water is accomplished by filling flexible open-topped containers, placing a container on the floor of a freezer, surrounding that container with four up-standing grid-like side walls to extend beyond the top of the container, supporting a temporary floor on those side walls above the first container, and placing a second filled container on the temporary floor thereby forming a column of filled containers within a freezer with good air circulation thereabout for freezing the water.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
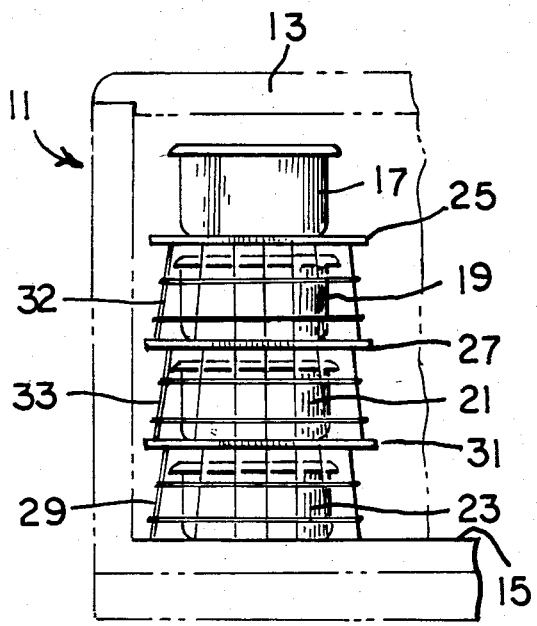
FIG. 1 illustrates a home freezer interior containing a stack of open-topped containers of water in side elevation view.

Referring first to FIG. 1, it will be noted that a home freezer, or deep freeze, 11 of the horizontal variety having a hinged top lid 13 and freezer floor 15 has stacked therein four open topped containers of water 17, 19, 21 and 23 with the uppermost container 17 resting on a relatively flat floor panel 25 and subadjacent container 19 resting on floor panel 27. The lowermost container 23 is supported directly on the freezer floor 15 and freezer floor 15 also supports a support rack 29 which in turn moving to superior elements in order, supports a floor panel 31, support rack 33 and, independent thereof, container 21 with support rack 33 in turn supporting floor panel 27 achieving the desired column of filled containers.

Figure 2:
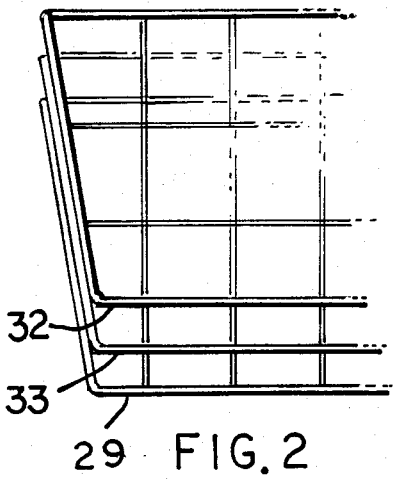
FIG. 2 is a partial side elevation view of a plurality of support racks in nested relationship for storage.
Figure 3:
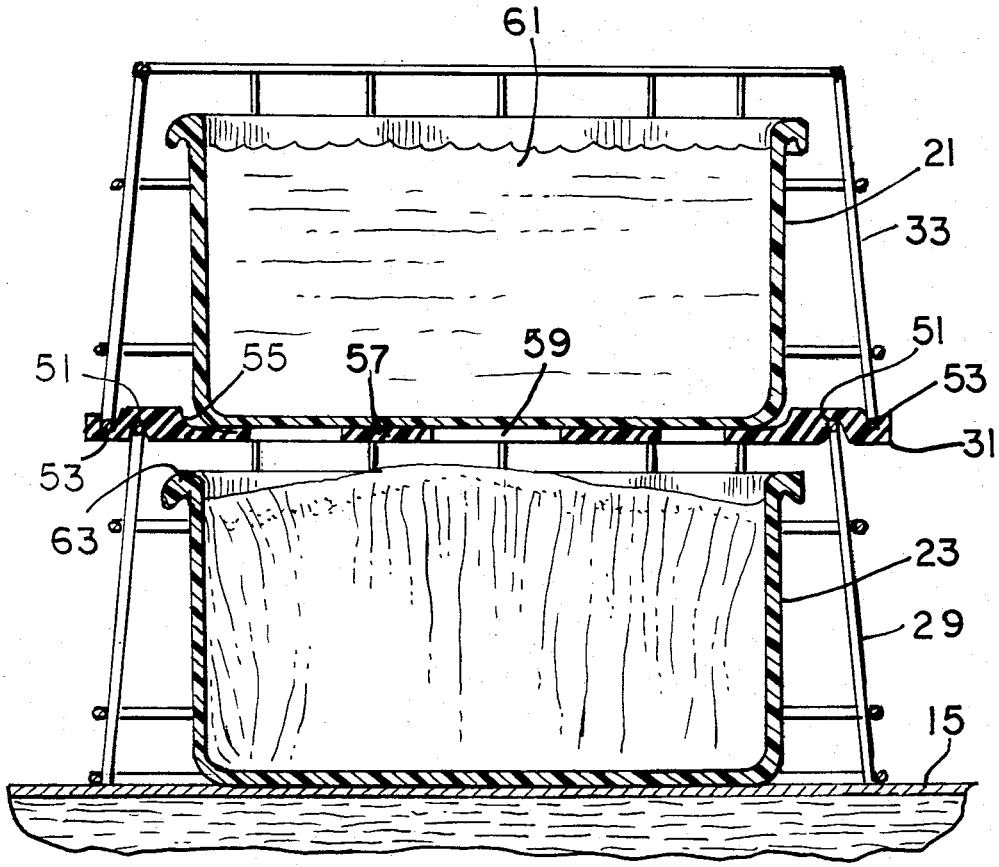
FIG. 3 is a view in cross section of two open topped containers and the arrangement for stacking those containers.
Figure 4:
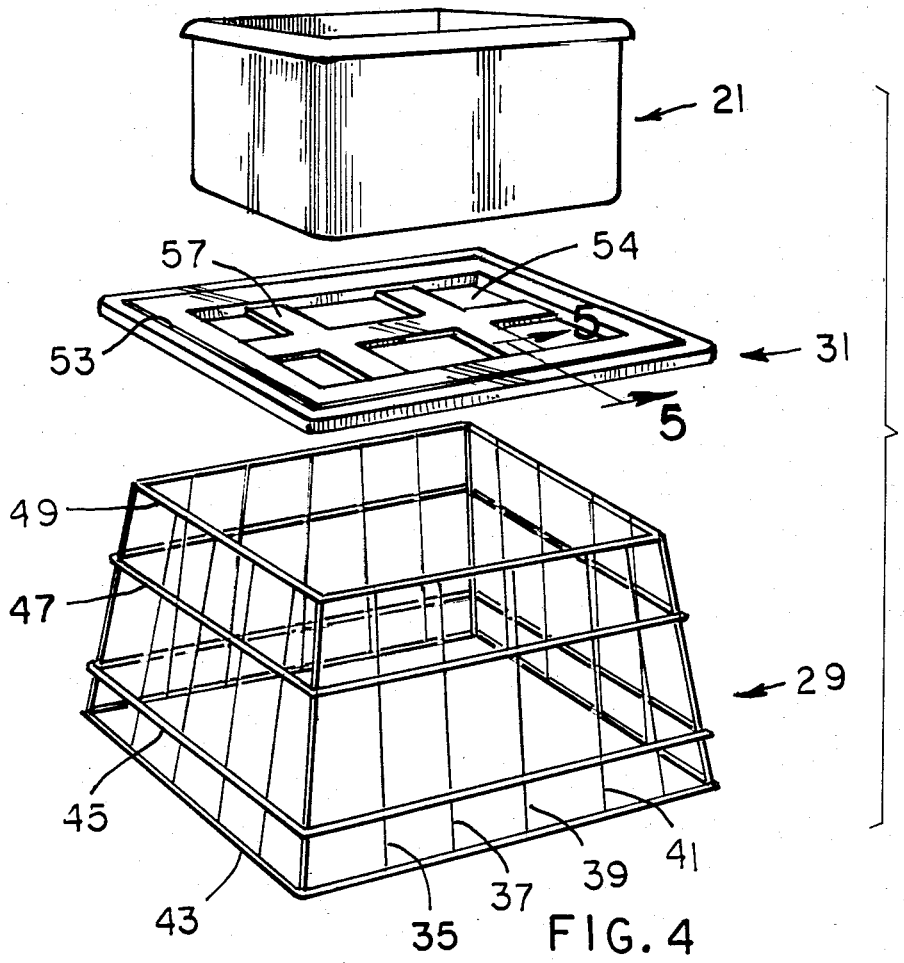
FIG. 4 is a perspective view of one container, supporting floor panel, and supporting rack.
Figure 5:
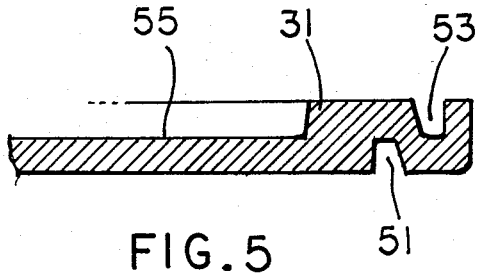
FIG. 5 is a view in section along line 5—5 of FIG. 4.

It will be noted from FIGS. 1, 3 and 4 that the support racks are of a generally truncated pyramidal configuration with open, generally parallel top and bottom faces so that those support racks may be nested as illustrated in FIG. 2 during periods of non-use or for storage or shipping.

The details of the support racks are probably best seen in FIGS. 3 and 4. Each support rack includes four trapezoidal side walls of an open mesh configuration with the top and bottom faces of the truncated pyramidal configuration being of sufficiently different rectangular size to allow the nesting as illustrated in FIG. 2. Each trapezoidal side is formed of a plurality of upright wires such as 35, 37 and 39 and at least three, and preferably four, horizontal wires such as 43, 45, 47 and 49. The grid-like arrangement of these wires then creates a nearly rectangular trapezoidal grid arrangement of wires. Individual wire pairs where they cross are substantially perpendicular or orthogonal and those crossing points or nodes desirably include a metallic bond such as a metal crimping process, spot welding, dip soldering, or other known bonding scheme to enhance the strength of the rack.

The temporary floors such as 31 are of a relatively flat configuration having generally rectangular outlines and each having a groove 51, as seen in FIG. 3, which groove passes around the entire periphery of the lower face of floor panel 31 and that groove receives an upper edge of the side walls of rack 29. The floor panel 31 also includes on the opposite or upper face a groove 53, as seen in FIGS. 3 and 4, for receiving the lower edges of the superior rack 33. Thus, these grooves cooperate to prevent sideward movement of a floor panel relative to either the subadjacent or superior rack securely locking successive racks and floor panels together in a columnar configuration.

Each floor panel, such as 31 as seen in FIGS. 3 and 4, also includes a container retaining depression 55 to help prevent movement of a container such as 21 on the floor panel. These floor depressions include support portions such as 57 and open portions such as 59 interspersed to allow air flow past the container bottom to aid cooling and to reduce the likelihood of trapping water between a container bottom and the floor panel, which water trapping would, upon subsequent freezing cause difficulty removing the container and block of ice from the floor panel. Preferably, floor panels such as 31 are formed as a one-piece molded plastic panel.

Not only are the racks, floor panels and containers interlocked as thus described and as most readily seen in FIGS. 1 and 3, but also the containers are held in locations slightly separated one from the other to aid rapid cooling and solidification of the water such as depicted in tray 21 to form ice such as depicted in tray 23.

The containers such as 21 are made of a somewhat flexible material, such as a rubber or plastic, and have open tops with the interiors being free of separators as normally encountered in ice cube trays. The container and, therefore, also the block of ice to be formed, will be configured generally as a rectangular, parallelepiped of a suitable size for subsequent use in a portable ice chest. Such a block of ice will be in the ten to fifty pound range with the containers such as 21 being configured somewhat like a rubber or plastic dishpan about one foot in width, slightly longer in length, and on the order of six inches deep.

The method of home freezing water in such relatively large blocks should now be clear. The like, flexible open topped containers 17, 19, 21 and 23 may be filled with water to a preferred level at about 61 in FIG. 3 and the first container 23 placed on the floor 15 of freezer 11. Container 23 is then surrounded by the four upstanding, grid-like sidewalls of rack 29, which extend from freezer floor 15 upwardly beyond the top surface 63 of container 23. The temporary grid-like floor 31 is then supported on the side walls of rack 29 above container 23 and a second filled container 21 placed on the temporary floor 31 thereby building a column of filled containers within the freezer with those containers separated somewhat for good air circulation thereabout for freezing the water. This sequence of steps is, of course, repeated as illustrated in FIG. 1 until the placement of an additional filled container would result in the interior freezer height being exceeded. Fewer containers may, of course, be placed in the freezer if desired and when container stacking is completed, lid 13 is closed to await freezing of the water in the containers.

Two further advantages of the ice making and storage system should now be clear. The racks and containers may be stacked in the corner of a home freezer to thereby occupy minimal freezer floor space. The open-topped container configuration allows for expansion of the water as it freezes without breaking the container.

From the foregoing it is now apparent that a novel arrangement for stacking water containers for freezing as well as a novel method of home freezing water in relatively large blocks has been disclosed meeting the objects and advantageous features set out hereinbefore as well as others, and that modifications as to the precise configurations, shapes and details may be made by those having ordinary skill in the art without departing from the spirit of the invention or the scope thereof as set out by the claims which follow.

What is claimed is:

1. An apparatus for the freezing of water in large blocks of ice comprising in combination:

a plurality of support racks each of a generally truncated pyramidal configuration with open generally parallel top and bottom faces each of a generally rectangular shape and trapezoidal side walls of an open mesh configuration;

a plurality of relatively flat floor panels of generally rectangular outline each having a first groove on the lower face spaced inwardly around the entire periphery and adapted to receive upper edges of the side walls of a subadjacent rack for locking said panel and subadjacent rack together to prevent sideward movement;

said floor panels having a second groove on the upper face spaced inwardly around the entire periphery and adapted to receive the lower edges of a superior rack for locking said superior rack with said floor panel to prevent sideward movement and permit said panels and racks to form a columnar configuration; and a plurality of containers adapted to be filled with water and arranged in a vertical column with the lowermost container resting on the floor of a freezer and subsequent containers each resting on one of said floor panels and each container except the uppermost one being surrounded by one of said racks.

2. The arrangement of claim 1 wherein the face of each floor panel having the grooves for receiving lower edges of a superior rack is provided with a container retaining depression.

3. The arrangement of claim 2 wherein each floor depression includes support portions and open portions interposed to allow air flow past the container bottom to aid cooling and to reduce the likelihood of the trapping of water and the subsequent formation of ice between the container and the floor.

* * * * *